US008740421B2

(12) United States Patent
Ramirez

(10) Patent No.: US 8,740,421 B2
(45) Date of Patent: Jun. 3, 2014

(54) LUMINAIRE WITH ENHANCED THERMAL DISSIPATION CHARACTERISTICS

(75) Inventor: Rafael M. Ramirez, Brooklyn, NY (US)

(73) Assignee: Litelab Corp., Buffalo, NY (US)

( * ) Notice: Subject to any disclaimer, the term of this patent is extended or adjusted under 35 U.S.C. 154(b) by 237 days.

(21) Appl. No.: 13/523,714

(22) Filed: Jun. 14, 2012

(65) Prior Publication Data

US 2012/0320608 A1 Dec. 20, 2012

Related U.S. Application Data

(60) Provisional application No. 61/497,026, filed on Jun. 14, 2011.

(51) Int. Cl.
*F21V 29/02* (2006.01)
*F21V 29/00* (2006.01)

(52) U.S. Cl.
CPC ..... *F21V 29/00* (2013.01); *F21V 29/02* (2013.01); *F21V 29/20* (2013.01); *F21V 29/004* (2013.01)
USPC ..... 362/373

(58) Field of Classification Search
CPC ..... F21V 29/00; F21V 29/02; F21V 21/088; F21V 29/002; F21V 29/20; F21V 29/004; F21V 29/22; F21V 29/2206; F21V 29/2293; F21V 29/26; F21V 33/0088; F21V 33/0092; F24F 3/056; F24F 13/078
See application file for complete search history.

(56) References Cited

U.S. PATENT DOCUMENTS 3,311,743 A 3/1967 Moore
5,158,136 A 10/1992 Azar
5,369,301 A 11/1994 Hayashi et al.
5,781,411 A 7/1998 Feenstra
5,946,190 A 8/1999 Patel et al.
6,173,758 B1 1/2001 Ward et al.
6,646,341 B2 11/2003 Miyamura et al.
6,926,071 B2 8/2005 Lee et al.
7,144,135 B2 12/2006 Martin et al.
7,488,093 B1 2/2009 Huang et al.
7,492,599 B1 2/2009 Yu et al.
7,494,251 B1 2/2009 Kira
7,742,302 B2 6/2010 Watanabe et al.
7,914,182 B2 3/2011 Mrakovich et al.
7,959,330 B2 6/2011 Hashimoto et al.
8,087,803 B2 * 1/2012 Zheng ..... 362/294
8,089,085 B2 1/2012 Shi
2005/0201104 A1 * 9/2005 Biber et al. ..... 362/341
2007/0230183 A1 10/2007 Shuy
2007/0279862 A1 * 12/2007 Li ..... 361/692
2008/0066888 A1 3/2008 Tong et al.
2009/0073689 A1 3/2009 Patrick
2009/0262530 A1 10/2009 Tickner et al.
2010/0014289 A1 1/2010 Thomas et al.
2010/0124058 A1 5/2010 Miller
2010/0204841 A1 8/2010 Chemel et al.

(Continued)

*Primary Examiner* — Bao Q Truong
(74) *Attorney, Agent, or Firm* — Hodgson Russ LLP

(57) ABSTRACT

A luminaire with enhanced thermal dissipation characteristics is disclosed. The luminaire may comprise a housing having a first external housing segment and a second external housing segment, the first and second external housing segments being spaced apart to provide an annular opening between the segments. A light source may be positioned at least partially within the first external housing segment, and a heat exchanger may be positioned at least partially within the second external housing segment. The luminaire described herein provides a light source with enhanced thermal dissipation features in an aesthetically pleasing package.

20 Claims, 11 Drawing Sheets

(56) References Cited

U.S. PATENT DOCUMENTS

2010/0254146 A1 10/2010 McCanless
2010/0328951 A1 12/2010 Boissevain
2011/0063843 A1 3/2011 Cook
2011/0170287 A1 7/2011 Medinis
2011/0216536 A1* 9/2011 Okazaki et al. ..... 362/235

* cited by examiner

LUMINAIRE WITH ENHANCED THERMAL DISSIPATION CHARACTERISTICS

CROSS-REFERENCE TO RELATED APPLICATION

This application claims the benefit of priority to U.S. provisional patent application Ser. No. 61/497,026, filed on Jun. 14, 2011.

FIELD OF THE INVENTION

The present invention relates to a luminaire with enhanced thermal dissipation characteristics. The present invention may be embodied as a luminaire having an external housing, a heat exchanger and a light source.

BACKGROUND OF THE INVENTION

Luminaires generally incorporate a light source that produces a substantial amount of heat. In the case of solid state light sources (e.g. light emitting diodes) this heat is detrimental to the performance and lifespan of the device. While convective cooling has long been used for similar applications, small solid-state light sources need to have large amounts of thermal energy removed relative to their size. Typical convective cooling will require a large heat dissipation area. As an alternate and to reduce the size of the cooling area, many mechanically enhanced alternatives exist. Such alternatives often include a fan, a vibrating membrane, or other similar means for forcing air to move over the convective surfaces. However, these alternatives detract from the overall energy efficiency of the luminaire. Also, noise made by such active cooling methods has been shown to be undesirable in quiet rooms, such as art galleries or libraries.

SUMMARY OF THE INVENTION

The invention may be embodied as a luminaire having an external housing, a light source, and a heat exchanger. The housing may have a first external segment and second external segment. These segments may be spaced apart such that an annular opening is provided between the segments. In one embodiment, the housing is substantially cylindrical. The annular opening is positioned to deliver air to the heat exchanger and through the second external housing segment.

In another embodiment, the first external housing segment has a tapered section curved to enhance air flowing into the second external housing segment. The first external housing segment may be tapered such that the diameter of the tapered end is less than the diameter of the second external housing segment, and in such an arrangement, the tapered end of the first external housing segment may extend into the second external housing segment.

The light source may be positioned at least partially, if not completely, within the first external housing segment. In one embodiment, the luminaire further comprises a high pressure clamp attaching the light source to the first external housing segment using at least one fastener.

The heat exchanger may be positioned at least partially, if not completely, within the second external housing segment. In one embodiment, the heat exchanger has a base with fins extending from the base. Each fin may be substantially cylindrical. In another embodiment, the fins are angled away from a central point on the base. The heat exchanger may be attached to the first or second external housing segment by at least one fastener.

In one embodiment, the luminaire has one or more clips. Each clip has an aperture, an overlapping portion, and an extending portion. The aperture is configured to accept a heat exchanger fin. The overlapping portion of the clip positions the extending portion of the clip at a desired distance from a free end of the heat exchanger fin. The extending portion of each clip may contact the second external housing segment. In another embodiment, the extending potion of each clip is configured to establish a friction fit between the second external housing segment and the clip. The clip may be configured such that the force exerted on each clip by the second external housing segment is transferred to the fin, thereby establishing a friction fit between the fin and each clip.

In another embodiment, a thermal interface material may be applied to a plurality of contact surfaces shared by the heat exchanger, the light source, and the housing. The thermal interface material may be a phase-change thermal transfer material, a silicon pad, thermal grease, or another suitable material. In another embodiment, the housing may be coated to increase heat emissivity.

In one embodiment, the luminaire further comprises an optical control component. The optical control component may at least partially cover the light source.

In one embodiment, the luminaire further comprises an extension arm configured to permit pivotal rotation of the housing.

BRIEF DESCRIPTION OF THE DRAWINGS

For a fuller understanding of the nature and objects of the invention, reference should be made to the accompanying drawings and the subsequent description. Briefly, the drawings are.

FURTHER DESCRIPTION OF THE INVENTION

Figure 1:
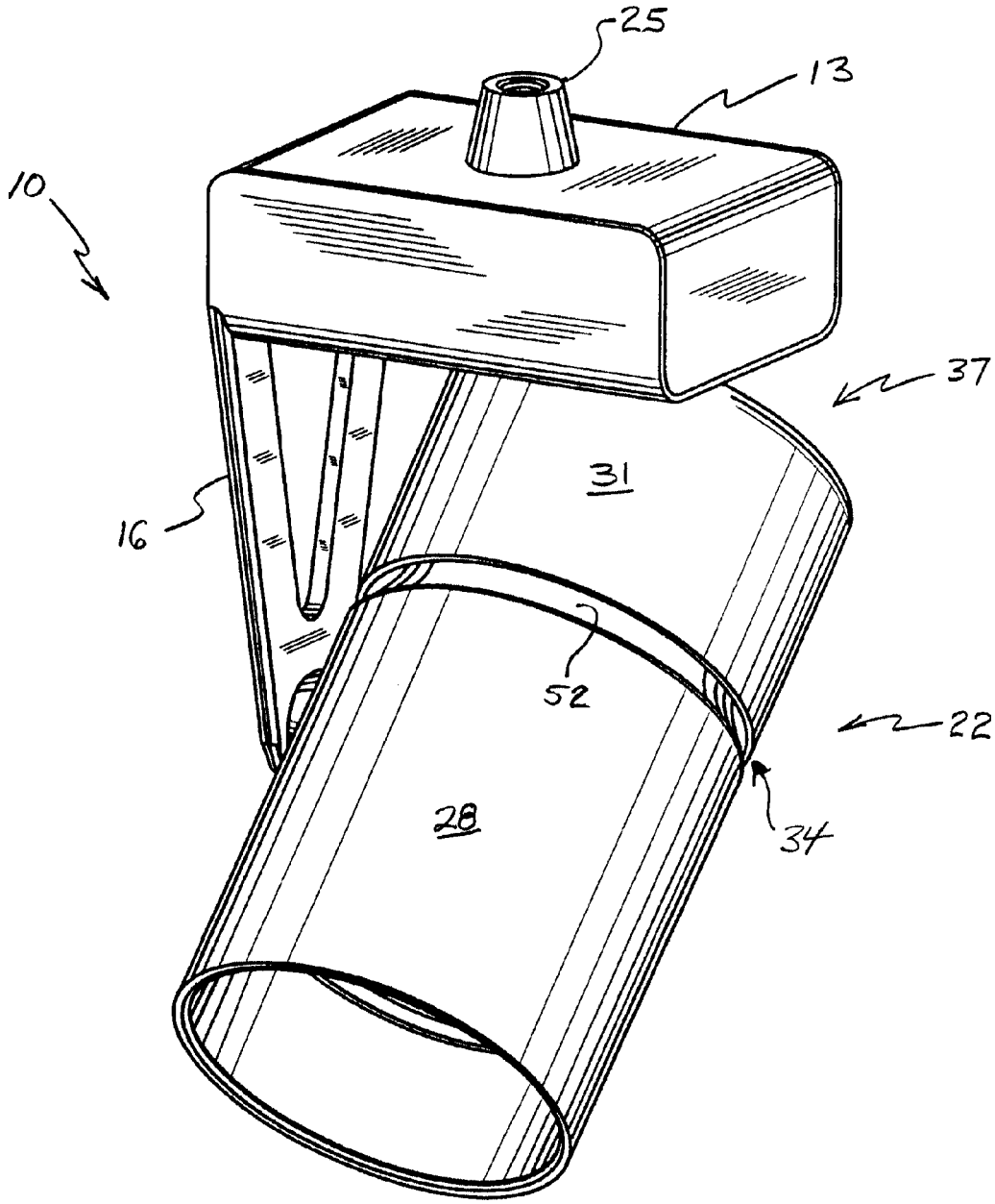
FIG. 1 is a perspective view of a luminaire according to the invention.
Figure 2:
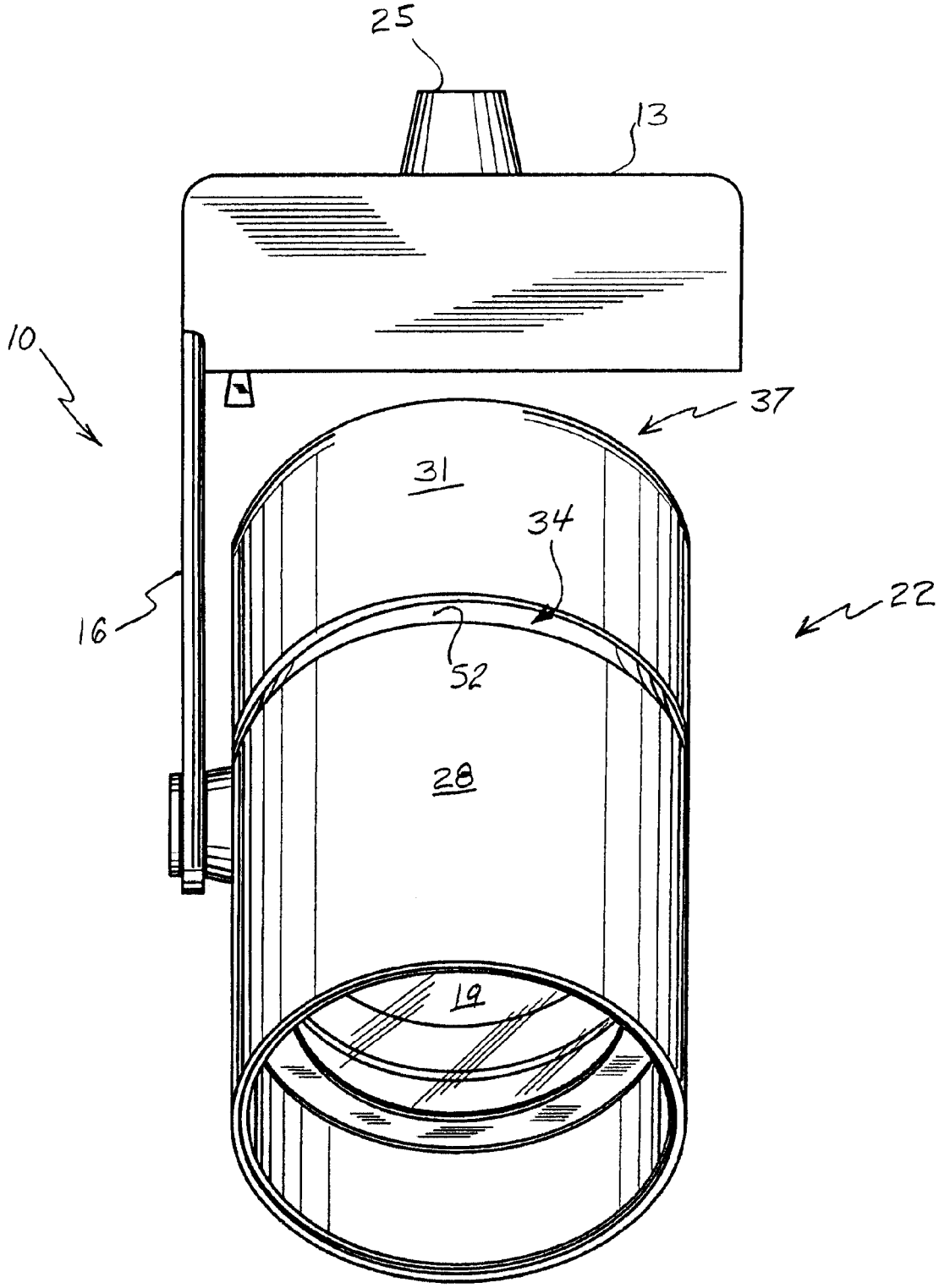
FIG. 2 is a front view of the luminaire depicted in FIG. 1.

The present invention proposes an improved method of thermal management by passive convective cooling and a method of assembly that minimizes or eliminates secondary machining processes. The present embodiment shows an LED light source, but the construction and method detailed here is suitable of other light sources and applications. FIGS. 1-7 show a luminaire 10 that is in keeping with the invention.

The luminaire 10 depicted in the figures has a power supply cover 13, an extension arm 16, a light source 19 (which may be in the form of a halogen light or a plurality of light emitting diodes), and a housing 22. The external housing provides an external surface of the luminaire, which may be visible to people who are occupying a space that is being illuminated by the luminaire. The power supply cover 13 may include a port 25, which is designed to receive an electrical conductor for supplying electricity to the light source 19 and to serve as a mounting method for the device. An interior surface of the port 25 may be threaded for receiving a conduit connector (not shown).

The external housing 22 may have a first external segment 28 and a second external segment 31. One of the external housing segments may be pivotally mounted to the extension arm 16 to allow for adjustment of the luminaire. In the figures, the first external housing segment 28 is shown pivotally mounted to the extension arm 16, and the light source 19 is shown residing within the interior space defined by the first external housing segment 28. The extension arm 16 may be mounted to the second external housing segment 31, or the first external housing segment 28.

The light source 19 may include a thermally conductive base 20 (see FIG. 8) into which the light source 19 is fixed. The base 20 may be a socket assembly which will allow for removal and replacement of the light source, and may include provisions for attachment of optical control components such as reflectors, lenses or diffusion media that may be used to achieve a desired lighting effect. The light source 19 may be mounted to the first housing segment 28 and the heat exchanger 43 by a high pressure clamping assembly 21. The rear wall 32 of first housing segment 28 may be sandwiched between the base 20 and the heat exchanger 43. The clamping assembly 21 may be made of metal or other thermally conductive material. The use of a high pressure clamping assembly 21 overcomes the need for special machining or other processes to ensure the flatness of the contact surface of a spun or drawn metal housing, which typically would not have the degree of flatness necessary to ensure optimal thermal transfer without additional processing, and ensures relatively complete contact over the full heat-dissipating surface of the base 20. Thermal interface materials (e.g., thermally conductive grease, phase-change type thermal transfer material, or silicon pad style thermal interface material) may be added between the base 20 and the first housing segment 28 to further improve heat transfer between the base 20 and rear wall 32. Such materials also may be used between the heat exchanger 43 and first housing segment 28.

Figure 9:
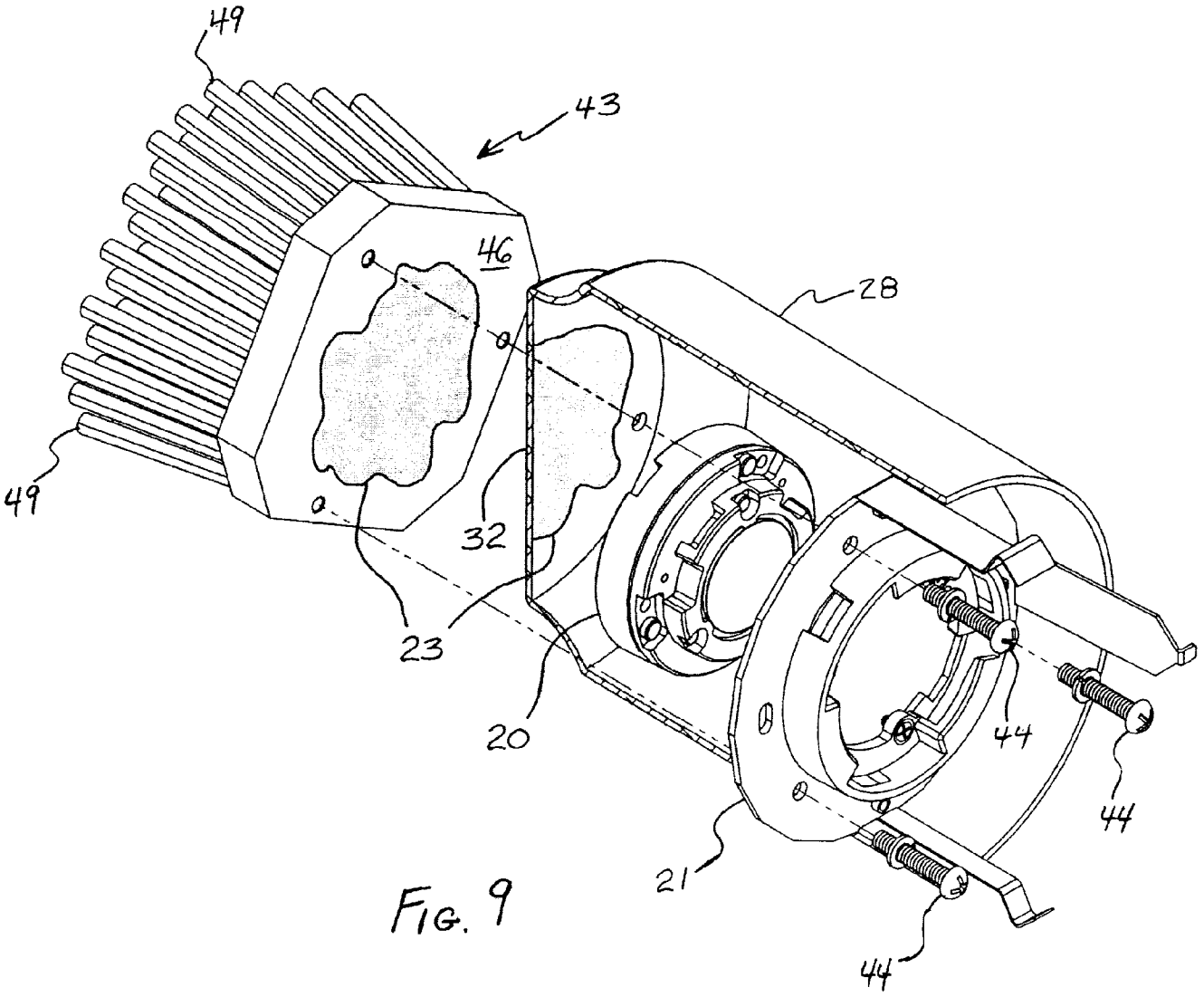
FIG. 9 is an exploded perspective view of a heat exchanger, a portion of the housing, hardware that may be used to attach the housing portion to the heat exchanger, and exemplary areas in which a thermal interface material may be applied.

FIG. 9 illustrates examples of areas 23 where a thermal interface material may be applied. The size and shape of the areas 23 may be adjusted as needed to achieve a desired thermal conductivity. Other types of thermal interface materials may also be applied in these areas 23. Thermal interface materials may also be applied to portions of base 20 that come in contact with the first housing segment 28. In another embodiment, thermal interface materials may be applied to portions of the first housing segment 28 that come in contact with heat exchanger 43.

Figure 11:
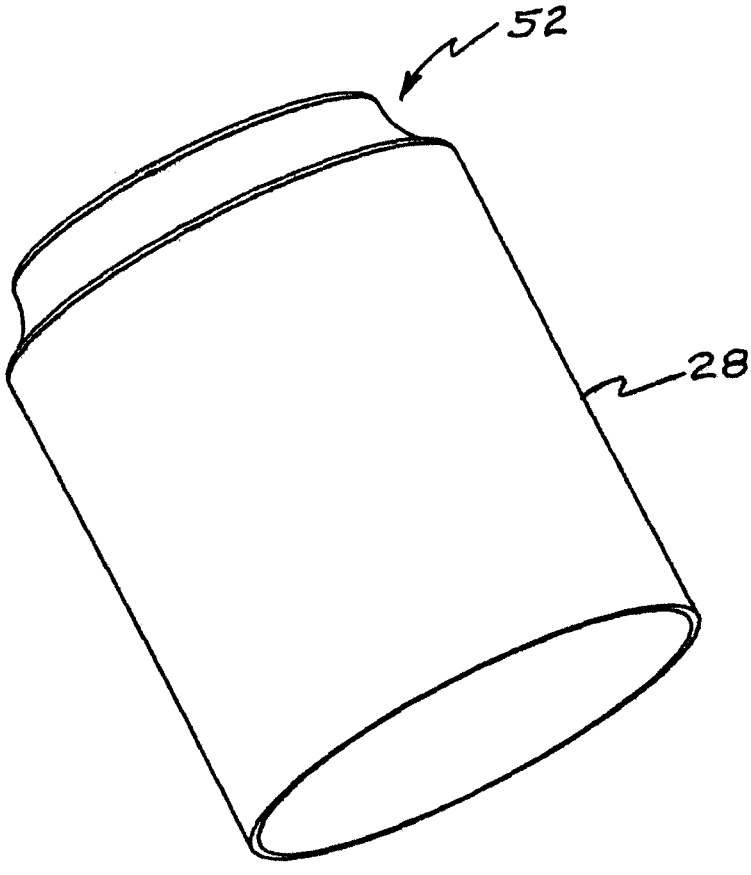
FIG. 11 is a side view of the first external housing segment showing a tapered end.

The first housing segment 28 may be spaced apart from the second housing segment 31 to provide an annular opening 34 between the housing segments 28 and 31. The second housing segment 31 partially encloses and creates a chamber for heat exchanger 43. The annular opening 34 between the housing segments 28 and 31 allows air to flow into and through the interior space defined by the second housing segment 31. A curved surface 52 on the first housing segment 28, in conjunction with the second housing segment 31, facilitates the flow of air into and through the second housing segment 31. FIG. 11 shows the tapered section 52 of the first housing segment 28. Use of a curved surface 52 reduces energy losses that would otherwise occur if an abrupt change in the housing surface were used, and thereby allows more air to pass through the second housing segment 31. The curved surface 52 channels air into the second housing segment 31 in a direction that is likely to facilitate movement of air through the second housing segment 31 and across the heat exchanger 43.

The upper end 37 of the second housing segment 31 that is distal from the first housing segment 28 is substantially open in order to provide an outlet 40 to allow air to leave the second housing segment 31. In this manner, air is allowed to flow through the second housing segment 31 in a direction extending from the annular opening 34 through heat exchanger 43 to the outlet 40 of the second housing segment 31. As the air passes through the second housing segment 31, heat is transferred from the heat exchanger 43, primarily by convection. When oriented to aim the light source 19 downward, cool air from the ambient surroundings is more easily drawn into the second housing segment 31 through the annular opening 34. The cool air is heated by the heat exchanger as the air passes through the second housing segment 31, and the heated air escapes via the outlet 40.

Figure 8:
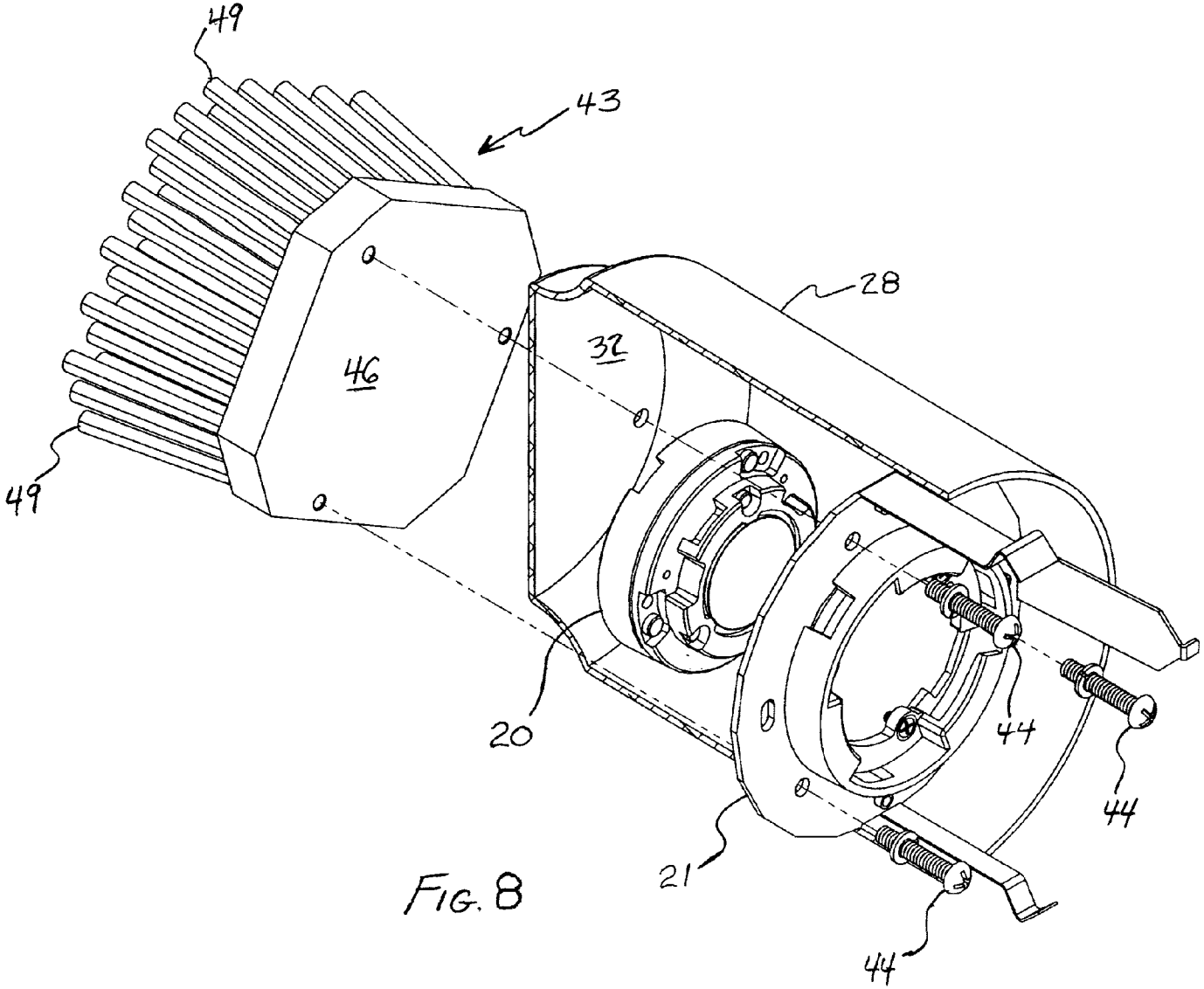
FIG. 8 is an exploded perspective view, partially cross sectioned, which depicts a means of clamping the light source to the housing.

The first housing segment 28 may be attached to heat exchanger 43 using hardware that is concealed from view. In FIGS. 8 and 9, such hardware is shown as screws 44 which extend through the clamp 21, base 20, rear wall 32 and into the heat exchanger 43. Such an arrangement utilizes the hardware to transfer heat from the base 20 and clamp 21 to the heat exchanger 43.

Figure 12:
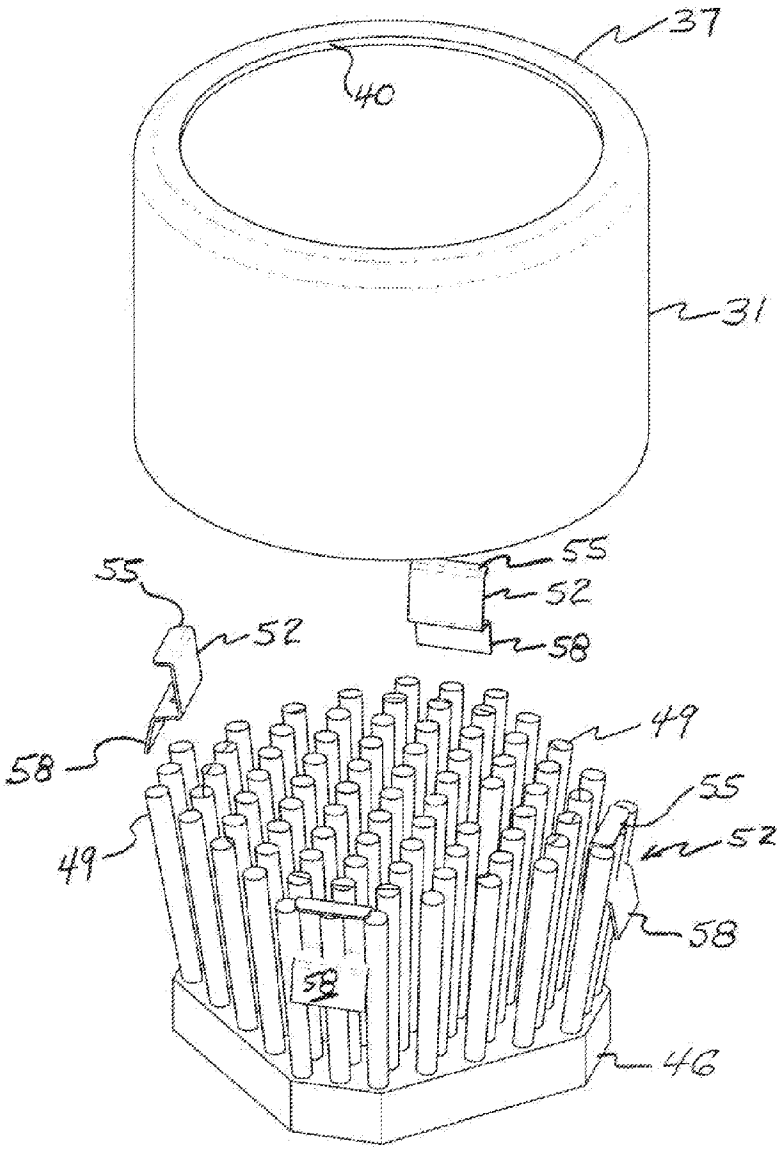
FIG. 12 is an exploded perspective view of a heat exchanger, a portion of the external housing, and hardware that may be used to attach the housing portion to the heat exchanger.

The second segment 31 may be attached to the heat exchanger 43 using hardware that is concealed from view, and also transfers heat from the heat exchanger 43 to the second segment 31. FIG. 12 shows one manner of attaching the heat exchanger 43 to the second segment 31. Four clips 52 are shown in FIG. 12, each with a hole through a central portion of the clip 52. Two of the clips 52 are shown positioned on different ones of the fins 49 of the heat exchanger 43 so that the fin 49 extends through the hole. An overlapping portion 55 of the clip 52 keeps the clip 52 positioned a desired distance from a free end of the fin 49. Distal from the overlapping portion 55 is an extending portion 58, which makes contact with the second segment 31 to establish a friction fit, which holds the second segment 31 to the clip 52. In addition, the force exerted on the clip 52 by the second segment 31, is transferred to the fin 49 and thus establishes a friction fit between the fin 49 and the clip 52, which holds the clip 52 to the fin 49. In this manner, the second segment 31 may be attached to the heat exchanger 43.

Figure 3:
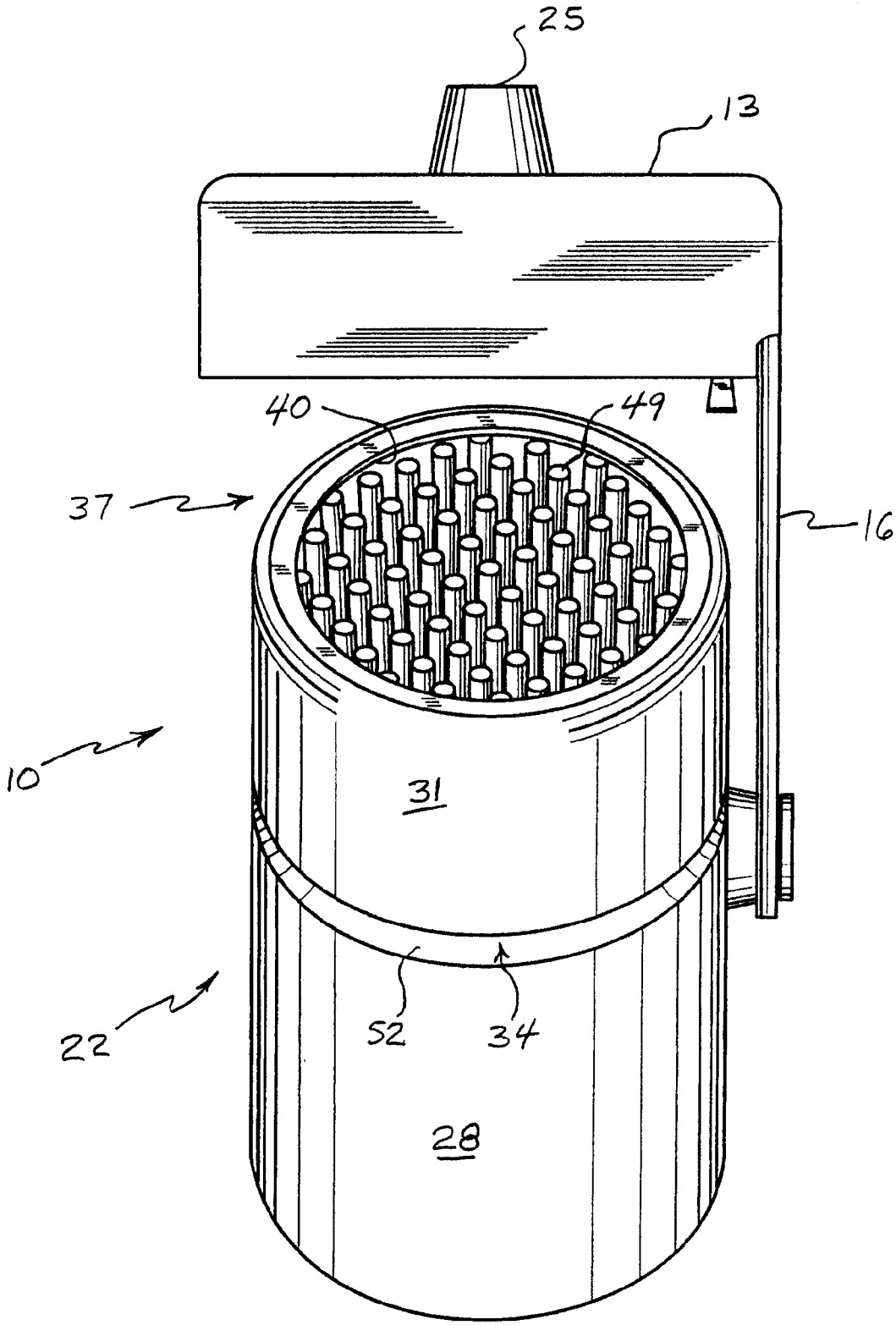
FIG. 3 is a rear view of the luminaire depicted in FIG. 1.
Figure 7:
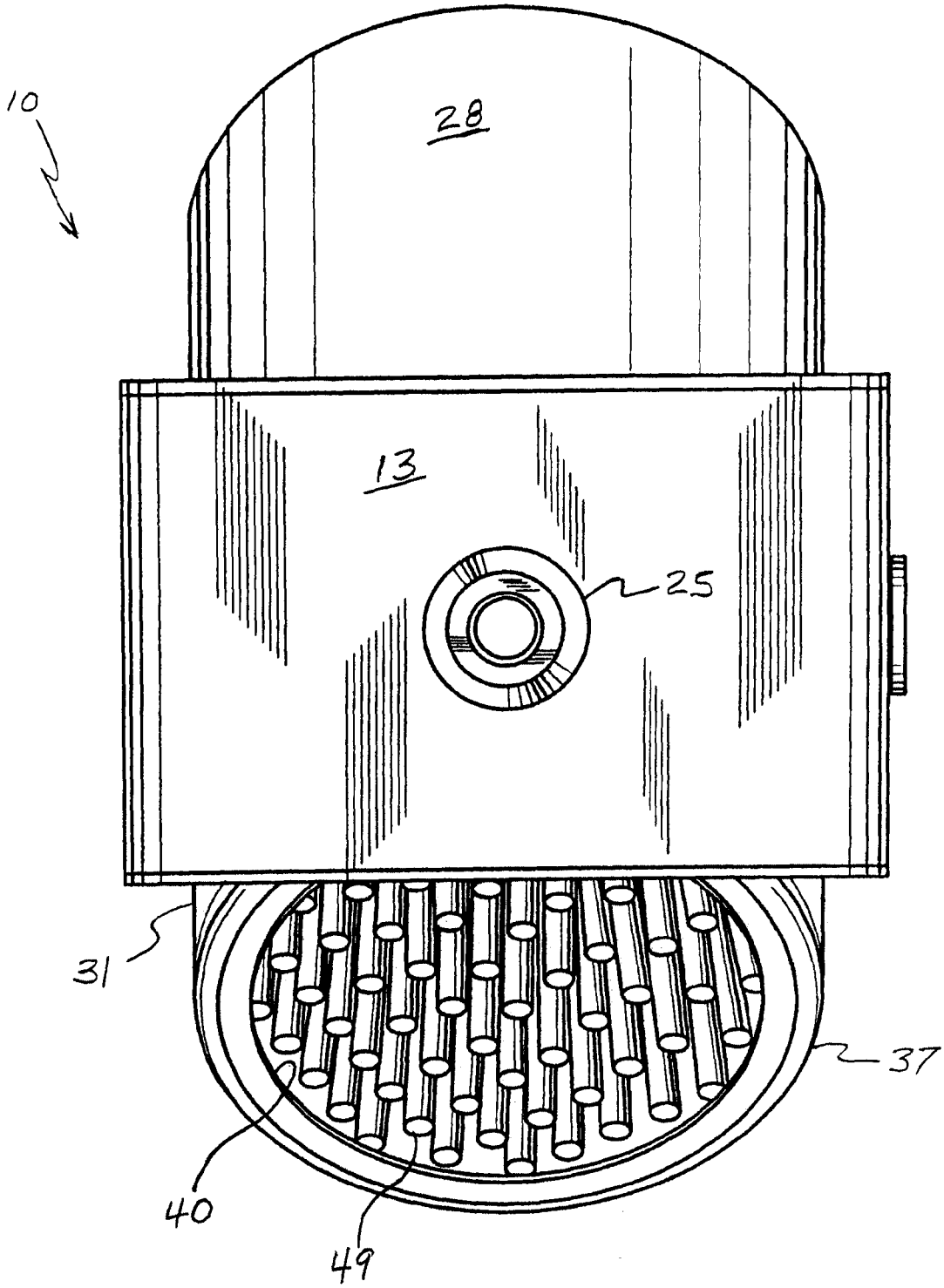
FIG. 7 is a top view of the luminaire depicted in FIG. 1.
Figure 10:
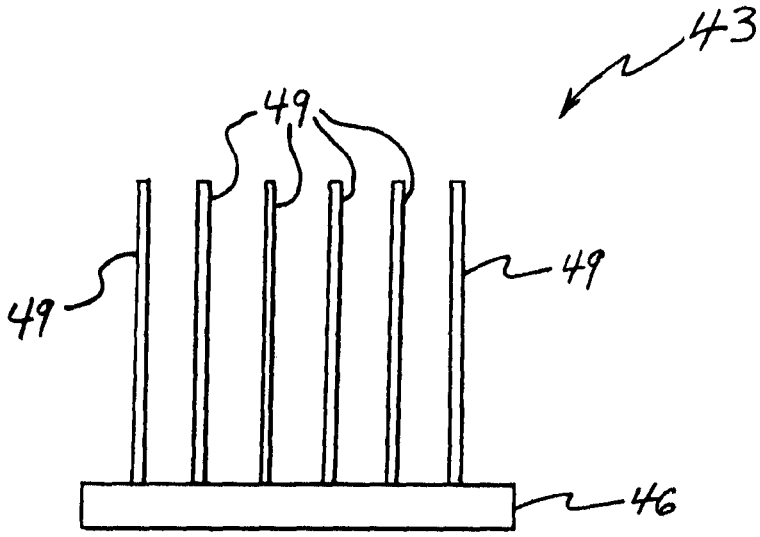
FIG. 10 is a side view schematic depicting a heat exchanger that may be used in the invention.

FIG. 10 is a schematic depiction of a heat exchanger 43 that may be used, and FIGS. 3 and 7 show part of the heat exchanger 43. FIGS. 8, 9, and 12 show the heat exchanger 43 in more detail. The heat exchanger 43 may have a base 46 and a plurality of fins 49 extending from the base 46. The fins 49 may be substantially cylindrical pins. The fins 49 reside in the interior space defined by the second segment 31. Air flowing from the annular opening 34 to the outlet 40 is allowed to circulate among the fins 49 and thereby receive heat from the fins 49. In this manner, heat from the light source 19 that is transferred to the heat exchanger 43 is ultimately transferred to the air via the fins 49. Such an arrangement is believed to provide improved cooling of the light source 19, which will result in a longer life. In addition, the temperature of the external housing 22 should be lower than prior art devices since a significant portion of the heat will be transferred to the ambient air via the fins 49, rather than via the external housing 22.

Figure 4:
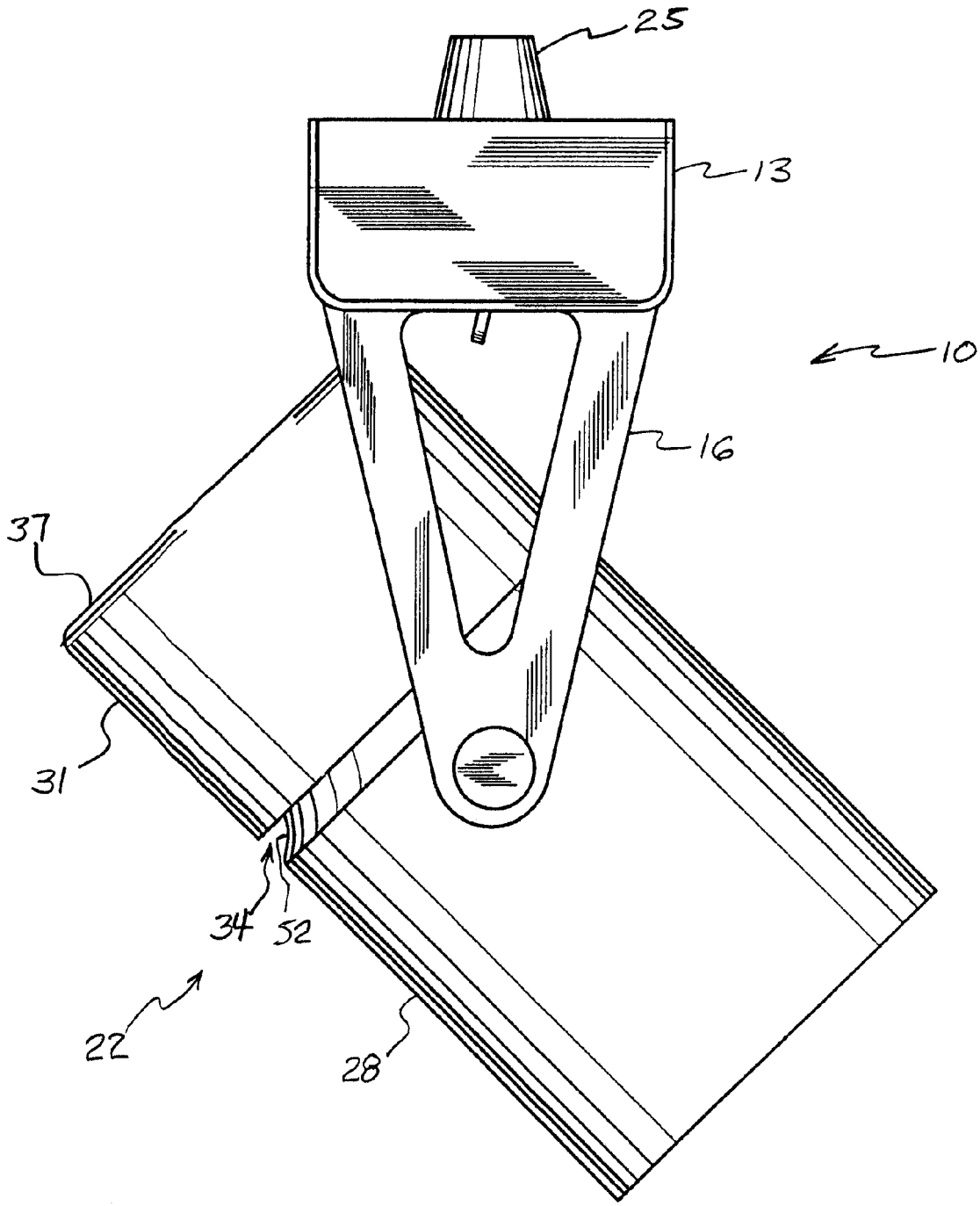
FIG. 4 is a side view of the luminaire depicted in FIG. 1.
Figure 5:
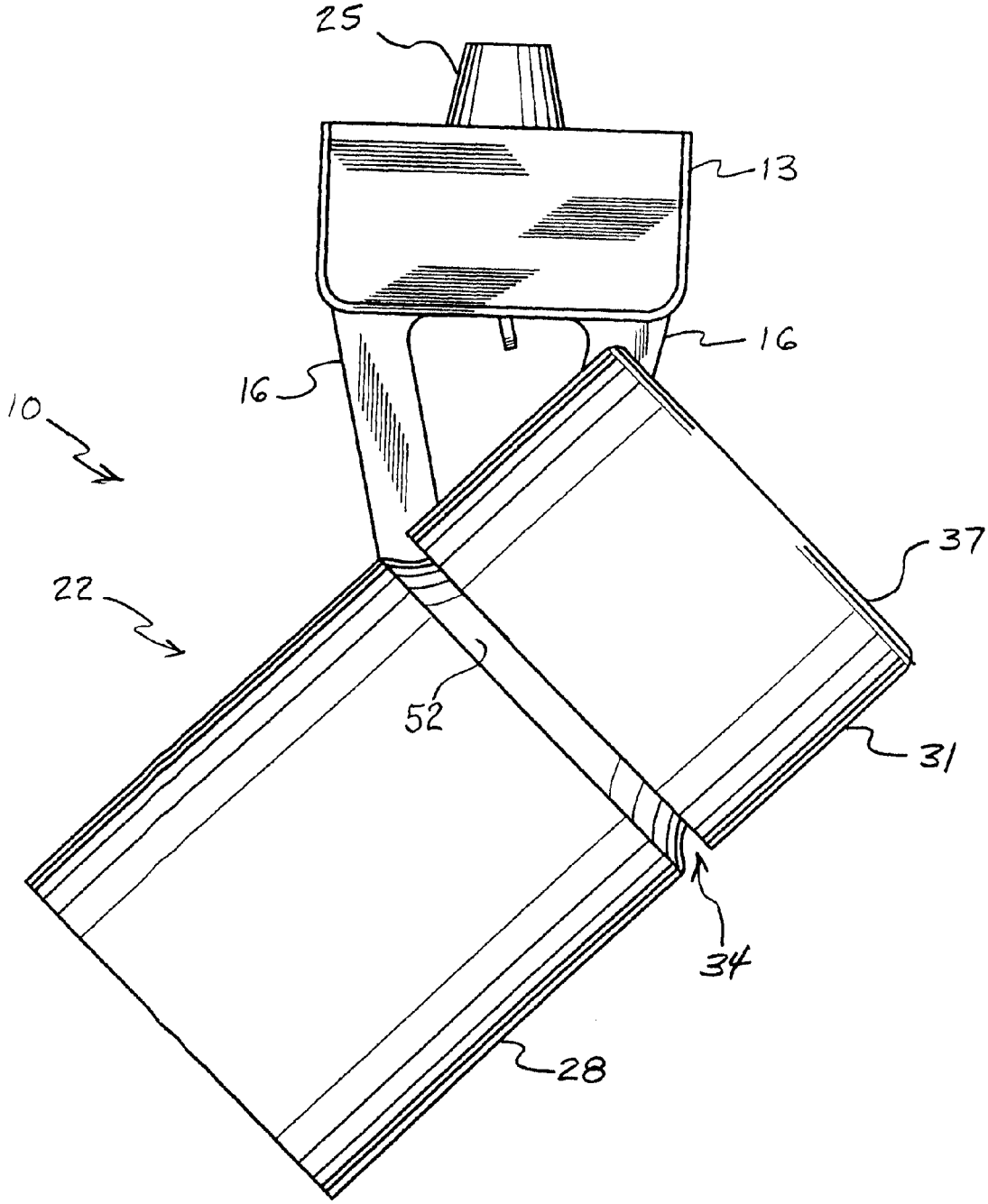
FIG. 5 is an alternate side view of the luminaire depicted in FIG. 1.
Figure 6:
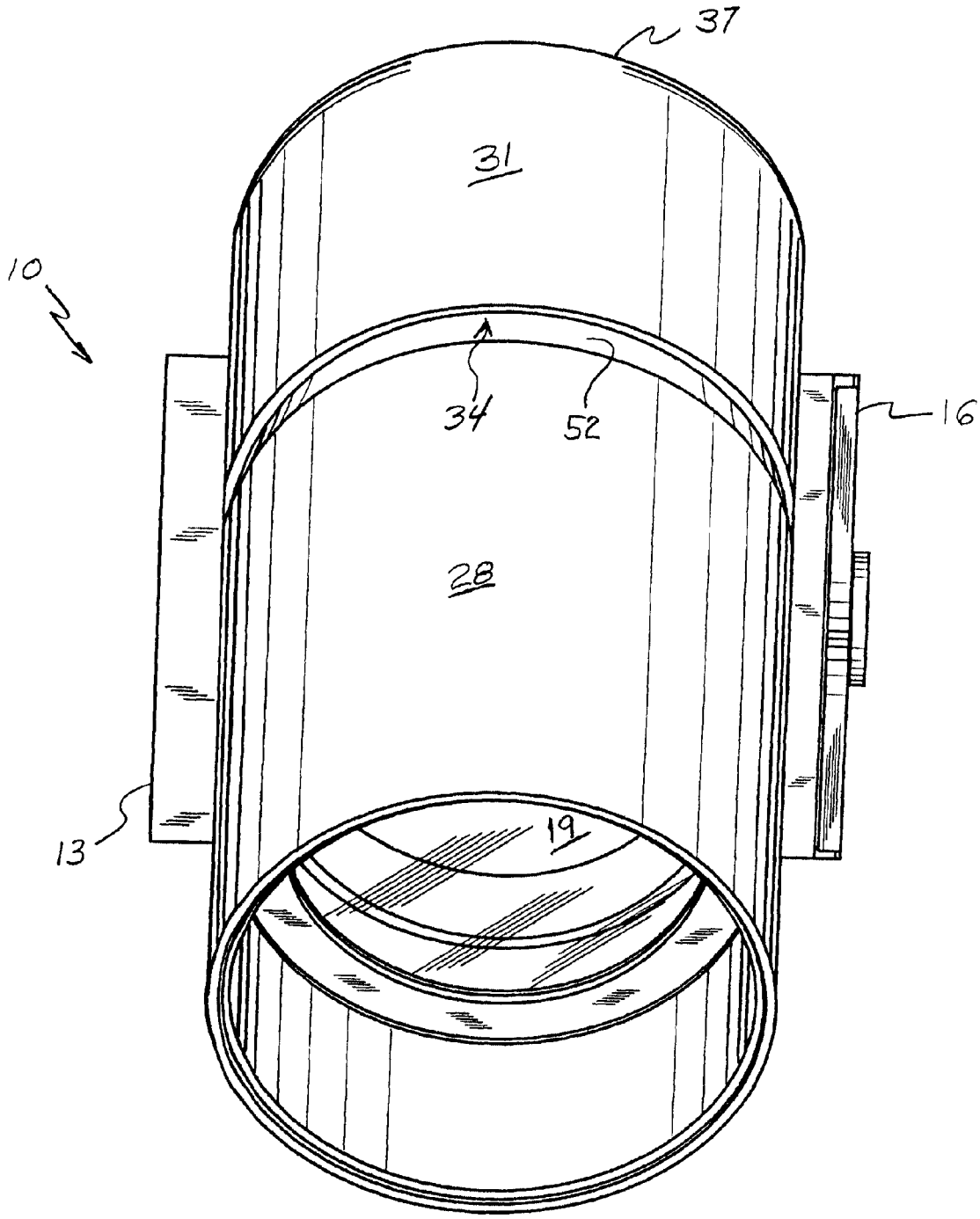
FIG. 6 is a bottom view of the luminaire depicted in FIG. 1.

It is desirable from a visual standpoint to not have the heat exchanger 43 visible from the typical viewing angle below a ceiling mounted luminaire, and to conceal as much of the assembly hardware as possible. To accomplish this, the tapered section 52 may be formed to fit within the second housing segment 31, and thereby inhibit people from seeing inside the external housing 22 while also channeling air into the second housing segment 31 and across the heat exchanger 43. FIGS. 1, 4, and 5 show the tapered section 52 of the first external housing segment 28 fitting within the second external housing segment 31.

As a result of the increased air flow, the surface of the second housing segment 31 operates at a significantly lower temperature than the first housing segment 28, thereby providing an area that a facilities worker might handle in relative comfort when repositioning or refocusing the luminaire after it has been in operation.

The heat exchanger 43 may be fabricated from commercially available components and materials. The embodiment depicted in the figures uses a pin style heat exchanger, but other designs, such as formed metal or heat pipes, may be used.

External housing segments 28 and 31 may be coated on their surfaces with a material to enhance emissivity. For example, commercially available powders and/or paint may be used to achieve this aspect of the invention.

It will now be recognized that the luminaire described herein provides a light source with enhanced thermal dissipation features in an aesthetically pleasing package.

Although the present invention has been described with respect to one or more particular embodiments, it will be understood that other embodiments of the present invention may be made without departing from the spirit and scope of the present invention. Hence, the present invention is deemed limited only by the appended claims and the reasonable interpretation thereof.

What is claimed is:

1. A luminaire comprising:

an external housing having a first external housing segment and a second external housing segment, the first and second external housing segments being spaced apart to provide an annular opening between the segments;

a light source positioned at least partially within the first external housing segment;

a heat exchanger positioned at least partially within the second external housing segment; and wherein the annular opening is positioned to deliver air to the heat exchanger and through the second external housing segment.

2. The luminaire of claim 1, wherein the housing is substantially cylindrical.

3. The luminaire of claim 1, wherein the first external housing segment has a tapered section, the tapered section being curved to enhance air flow into the second external housing segment.

4. The luminaire of claim 1, wherein the first external housing segment has a tapered end, such that the diameter of the tapered end is less than the diameter of the second external housing segment.

5. The luminaire of claim 4, wherein the tapered end of the first external housing segment extends inside the second external housing segment.

6. The luminaire of claim 1, wherein the heat exchanger comprises a base and fins extending from the base.

7. The luminaire of claim 6, wherein the fins are substantially cylindrical.

8. The luminaire of claim 6, wherein the fins are angled away from a central point on the base.

9. The luminaire of claim 1, further comprising an optical control component at least partially covering the light source.

10. The luminaire of claim 1, further comprising a thermal interface material applied to a plurality of contact surfaces shared by the heat exchanger, the light source, and the housing.

11. The luminaire of claim 10, wherein the thermal interface material is a phase-change thermal transfer material.

12. The luminaire of claim 10, wherein the thermal interface material is a silicon pad.

13. The luminaire of claim 10, wherein the thermal interface material is a thermal grease.

14. The luminaire of claim 1, wherein at least some of the housing is coated to increase heat emissivity.

15. The luminaire of claim 1, further comprising an extension arm configured to permit pivotal rotation of the housing.

16. The luminaire of claim 1, further comprising at least one fastener attaching the heat exchanger to the first external housing segment.

17. The luminaire of claim 16, further comprising a high pressure clamp attaching the light source to the first external housing segment using the at least one fastener.

18. The luminaire of claim 6, further comprising one or more clips, the one or more clips each having an aperture, an overlapping portion, and an extending portion, wherein each aperture is configured to accept a heat exchanger fin, and each overlapping portion positions the extending portion at a desired distance from a free end of the heat exchanger fin.

19. The luminaire of claim 18, wherein the extending portion of each clip contacts the second external segment of the housing.

20. The luminaire of claim 19, wherein the extending potion of each clip is configured to establish a friction fit between the second external housing segment and the clip such that the force exerted on each clip by the second external housing segment is transferred to the fin, thereby also establishing a friction fit between the fin and each clip.

* * * * *